US005392802A

United States Patent [19]

Farr et al.

[11] Patent Number: 5,392,802

[45] Date of Patent: * Feb. 28, 1995

[54] FOLDING TRAY FOR INVALID WALKERS

[75] Inventors: C. P. Farr, Scarborough, Canada; Nate Ellena, Woodland Hills; Jim R. Schultz, Thousand Oaks, both of Calif.

[73] Assignee: Gaurdian Products, Inc., Simi Valley, Calif.

[ * ] Notice: The portion of the term of this patent subsequent to Dec. 28, 2010 has been disclaimed.

[21] Appl. No.: 118,498

[22] Filed: Sep. 8, 1993

Related U.S. Application Data

[62] Division of Ser. No. 696,502, May 7, 1991, Pat. No. 5,273,063.

[51] Int. Cl.[6] ..... A45B 3/00

[52] U.S. Cl. ..... 135/66; 135/67

[58] Field of Search ..... 135/65-67; 297/5-7; 482/66, 68; 280/87.021

[56] References Cited

U.S. PATENT DOCUMENTS

| | | | |
|---|---|---|---|
| 170,237 | 8/1853 | Randall . | |
| 2,430,235 | 11/1947 | Mendenhall . | |
| 2,798,651 | 7/1957 | Wasyluk . | |
| 3,181,483 | 5/1965 | De Vitt et al. . | |
| 3,354,893 | 11/1967 | Schmerl . | |
| 3,401,650 | 9/1968 | Terezas . | |
| 3,516,425 | 6/1970 | Rigal . | |
| 3,586,276 | 6/1971 | O'Mahoney . | |
| 3,656,681 | 4/1972 | Goings . | |
| 3,957,071 | 5/1976 | Kenner . | |
| 4,074,683 | 2/1978 | Di Chiara . | |
| 4,086,932 | 5/1978 | Richardson . | |
| 4,105,247 | 8/1978 | Saint . | |
| 4,111,305 | 9/1978 | Thomas . | |
| 4,184,618 | 1/1980 | Jones . | |
| 4,212,493 | 7/1980 | Ledesky . | |
| 4,251,044 | 2/1981 | Olson . | |
| 4,253,678 | 3/1981 | Leclerc . | |
| 4,277,100 | 7/1981 | Beougher . | |
| 4,449,750 | 5/1984 | Pultman . | |
| 4,484,755 | 11/1984 | Houston . | |
| 4,491,257 | 1/1985 | Ingles . | |
| 4,659,099 | 4/1987 | Malone . | |
| 4,676,416 | 6/1987 | Harmon . | |
| 4,708,274 | 11/1987 | Roche . | |
| 4,800,911 | 1/1989 | Endres . | |
| 4,830,243 | 5/1989 | Mann . | |
| 4,907,839 | 3/1990 | Rose et al. . | |
| 4,910,427 | 3/1990 | Beatly | 135/66 |
| 4,946,058 | 8/1990 | Stamm . | |
| 5,273,063 | 12/1993 | Farr et al. | 135/66 |

FOREIGN PATENT DOCUMENTS 1103185 2/1968 United Kingdom .

OTHER PUBLICATIONS

American Abbey Homecare catalog, Mar. 1986.
Fred Sammons, Inc. promotional sheet.
Domat Company brochure.

*Primary Examiner*—Lanna Mai
*Attorney, Agent, or Firm*—Willian Brinks Hofer Gilson & Lione

[57] ABSTRACT

A fold-down detachable utility tray for invalid walkers is disclosed, including a generally rectangular tray frame in combination with a pair of locking, fold-down arms each having spring clips for securement to the upright members of an invalid walker. In one preferred embodiment, the center of gravity of the tray is located over the pivot point of the locking arms, so that the weight of objects placed on the tray causes the arms to lock more tightly, promoting stability of the tray. The locking arms each include an elongated angle bracket provided with a pivot. An actuator arm has a first end movably connected to the pivot and a second end slidingly engaged in a slot in the tray frame. One end of the slot is provided with a upwardly extending locking notch to hold the arm in the extended position.

5 Claims, 5 Drawing Sheets

FOLDING TRAY FOR INVALID WALKERS

This application is a division of application Ser. No. 07/696/502, filed May 7, 1991, Now U.S. Pat. No. 5,273,063.

FIELD OF THE INVENTION

The present invention generally relates to accessories for walker apparatus used by persons having impaired ambulatory mobility. The present invention specifically relates to demountable folding and locking tray apparatus for attachment to invalid walkers enabling transport of objects on the tray.

PRIOR ART

Persons with impaired mobility due to a physical handicap or old age often can improve mobility through use of a lightweight movable device commonly known as a "walker." Typical walkers include four generally vertical legs interconnected by bracing and terminating at their upper ends in two generally horizontal hand grip bars. In use, the hand grip bars are both gripped by the user, leaving the user with no way to carry articles while moving the walker.

To enable users of walkers to carry small articles while moving a walker, prior inventors have devised several ways to attach a basket or horizontal tray to a walker. For example, U.S. Pat. No. 4,946,058 (Stamm) discloses a walker in combination with a tray which includes a tray member having a bottom and four sides. Two sides have interior recesses which form upwardly facing support shoulders. A pair of upstanding arms, each rigidly affixed by attachments to the opposite sides of the tray, allow the tray to hang from the walker. Apertures in the upper section of the arms receive hook retainer ends of an elongated link. Upper portions comprising rings, each of which is secured by a plastic tie to the crossbar of the walker, are connected to the link.

U.S. Pat. No. 4,074,683 (Di Chiara) discloses a walker with a tray which includes a cradle constructed of a plurality of shaped stainless steel rods fastened together to form a cradle or support for a removable tray. The cradle is attached to the walker between the legs using angle brackets, each comprising a horizontal arm, a vertical extension, and a slot extending to the upper end of the extension. The angle bracket is secured to the front legs and sleeves located on the legs by a clamp on each side.

U.S. Pat. No. 3,516,425 (Rigal) illustrates a folding walker assembly incorporating support bars in the side frame of the walker for holding the edges of a folding table. The table includes a generally rectangular portion having an edge defined by an angle member secured thereto, and having a pair of spaced bolts which extend through aligned vertical openings in the support bar and are secured thereto by wing nuts. The rectangular center portion is hinged to section by a continuous or other suitable hinge.

U.S. Pat. No. 2,430,235 (Mendenhall) discloses a walker with a tray rigidly attached to the front of the walker. The tray is provided with an extension at each side edge which lies flat against the inner surface of the upper side braces of the walker to which they are attached.

However, the prior art patents include a number of deficiencies which are eliminated by the present invention. Stamm, Di Chiara and Mendenhall do not provide mans for storing the tray in association with the walker; for storage, the trays of Stamm, Di Chiara and Mendenhall must be completely removed from the walker and placed aside. Rigal provides a folding tray, but the walker itself must be collapsed to permit folding the tray.

The devices of the prior art patents also are prone to instability since the walker may tip over if the prior art trays are overloaded. Stamm also tends to obstruct the area in the walker frame occupied by the user's legs.

Thus, the prior art appears to be deficient in failing to provide a walker tray which is moveable to a storage position proximate the walker without removal of the tray from the walker. The prior art also does not provide a walker tray easily moved from a storage position to a raised, locked position.

The prior art is likewise deficient in failing to provide a walker tray having a center of gravity point located directly above the interior of the walker framework, such that the weight of articles placed on the tray is over the walker framework, thereby promoting stability of the tray apparatus and walker. The prior art also does not provide an open tray support frame having spring clips adapted to receive a removable tray.

SUMMARY OF THE INVENTION

Accordingly, one object of the present invention is to provide a demountable article carrying tray apparatus for invalid walkers which is pivotable from a lower storage position proximate the legs of the walker to a raised and locked generally horizontal position.

Another object of the present invention is to provide a walker tray apparatus in which movement of the tray apparatus is effected by manual pressure on the tray.

A further object of the present invention is to provide walker tray apparatus having a storage position proximate the walker framework but located to preclude interference between the stored tray and the legs of the person using the walker.

Still another object of the present invention is to provide walker tray apparatus which, when mounted to the walker framework, has a center of gravity point falling within the base framework of the walker.

Yet another object of the present invention is to provide walker tray apparatus having releasable yet secure locking means for locking the tray apparatus in the raised position.

Yet a further object of the present invention is to provide walker tray apparatus including a separate tray, and releasable means for removing the tray from the apparatus.

The foregoing objects, and other objects which will become apparent from the detailed description of the preferred embodiments given below, are achieved through provision of a walker with tray apparatus preferably comprising a generally rectangular tray support frame having spring clips thereon for releasably retaining a tray on the tray support frame, and a pivot mechanism including elongated slots in the sides of the tray frame, plural pivot arms each having one end slidably mounted in one of the slots and another end rotatably mounted on one of plural mounting brackets. The brackets include plural spring clips for releasable securement to the walker legs.

The apparatus is constructed to mount on the walker such that the center of gravity of the apparatus is located over the interior of the walker framework, thereby promoting stability of the walker and tray apparatus and preventing the walker from tipping when the tray is loaded. The tray of the apparatus extends only a short distance laterally into the walker frame, ensuring that no interference will occur with the legs of the user of the walker.

DETAILED DESCRIPTION

In the following detailed description of the preferred embodiments, certain specific descriptive terminology is used for the sake of clarity. However, the present invention is not limited to the particular terms so selected, but rather encompasses all technically equivalent structures for accomplishing substantially the same result in substantially the same manner.

Figure 1:
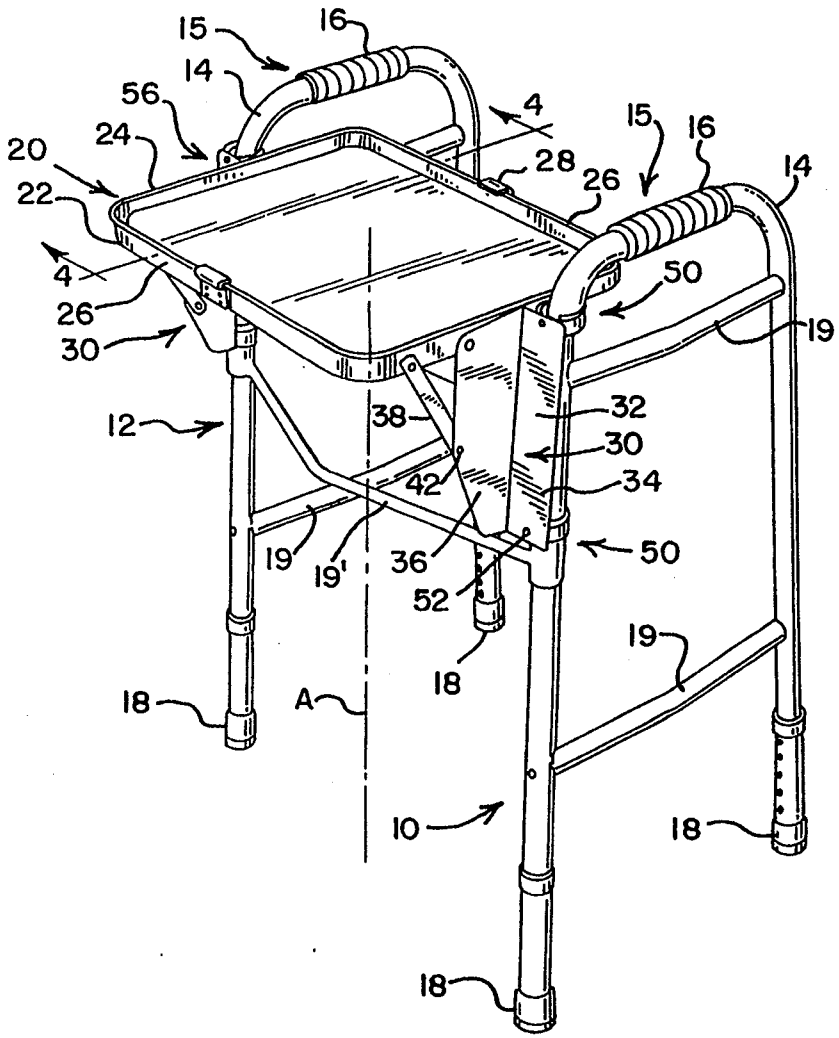
FIG. 1 is a perspective view of an invalid walker incorporating a walker tray apparatus of the present invention.

Referring generally to FIGS. 1 through 5, and referring specifically to FIG. 1, a walker 10 is shown in combination with apparatus according to the present invention, including tray support means 20, locking and pivoting means 30, and gripping means 50. The walker 10 is of conventional design, and preferably comprises two opposed inverted U-shaped leg members 14, which may be constructed of any suitable lightweight, strong material, preferably aluminum tubing. At the apex 15 of leg members 14, hand grips 16 are provided, by which a person may grip the walker 10. Resilient end caps or feet 18 are provided which enable the walker 10 to securely grip the floor below. As is known in the art, leg members 14 may be braced in any suitable manner using cross braces 19, which are also preferably constructed of aluminum tubing. Front brace 19' preferably is formed in the shape of a wide, flat "V" as shown in FIG. 1

Also as indicated in FIG. 1, tray support means 20 is provided proximate to walker 10. Support means 20 includes a framework 22 preferably constructed of aluminum bar stock formed generally into a rectangle, and including front and rear frame members 26 and side frame members 24. Spring clips 28 are provided on members 26 to enable removal of a tray 100 supported by means 20. The tray 100 is preferably a formed plastic tray of the type commonly used in cafeterias, but any other tray, suitable to be carried by support means 20, may be employed.

Locking and pivoting means 30 is likewise provided proximate to walker 10 for facilitating downward tilting of tray support means 20. Pivoting means 30 includes an angle bracket 32 having a first generally rectangular arm 34 and a second arm 36 preferably joined at a 90-degree angle.

Gripping means 50 are secured to the rear face of arm 34 using any suitable fasteners 52, such as rivets, bolts, etc. Gripping means 50 may comprise rearwardly facing conventional spring clips 54 of FIG. 4, or any other gripping means, provided the gripping means can securely grasp a tubular object such as leg members 14 and hold bracket 32 tightly against the leg member 14.

Figure 4:
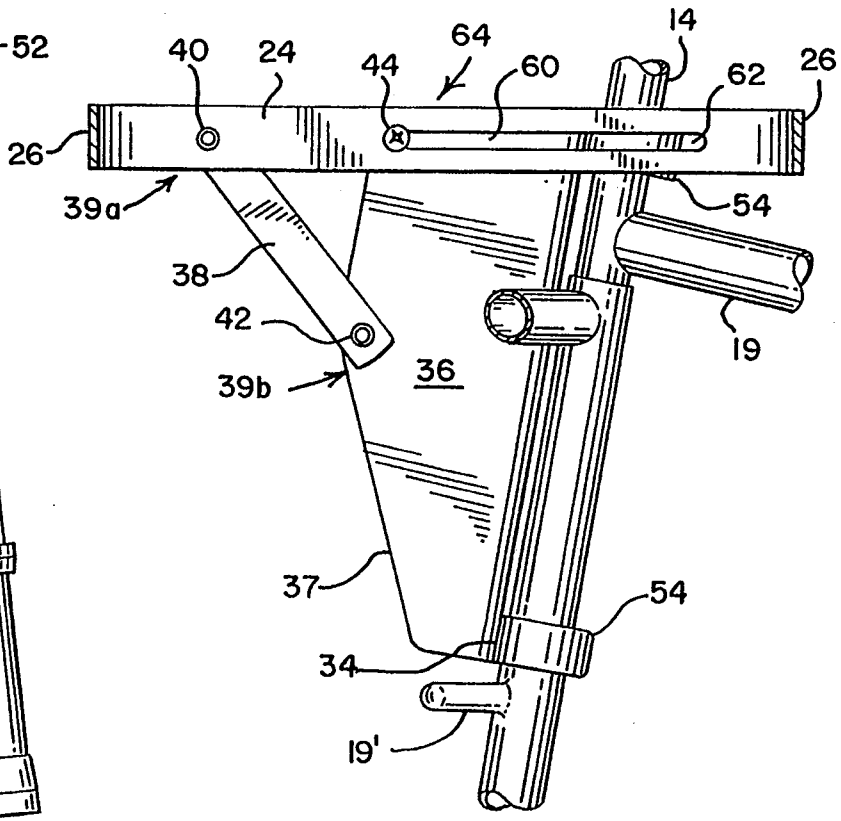
FIGS. 4, 5 and 6 are side elevation views showing the apparatus in raised, partly lowered, and completely lowered positions, respectively.

As indicated in FIGS. 1 and 4, an elongated pivot arm 38 is provided in pivot means 30 and has one end 39B pivotally connected to arm 36 using any suitable pivoting means 42, such as a rivet, stud, bolt, etc. The opposite end 39A of arm 38 is pivotally secured to frame 22 using pivot 40, which also may comprise a rivet, bolt, or other suitable pivoting means. Pivot arm 38 ensures that tray 100 and frame 22 follow a narrowly circumscribed path through space as the tray 100 is tilted forward during operation of the apparatus.

Figure 2:
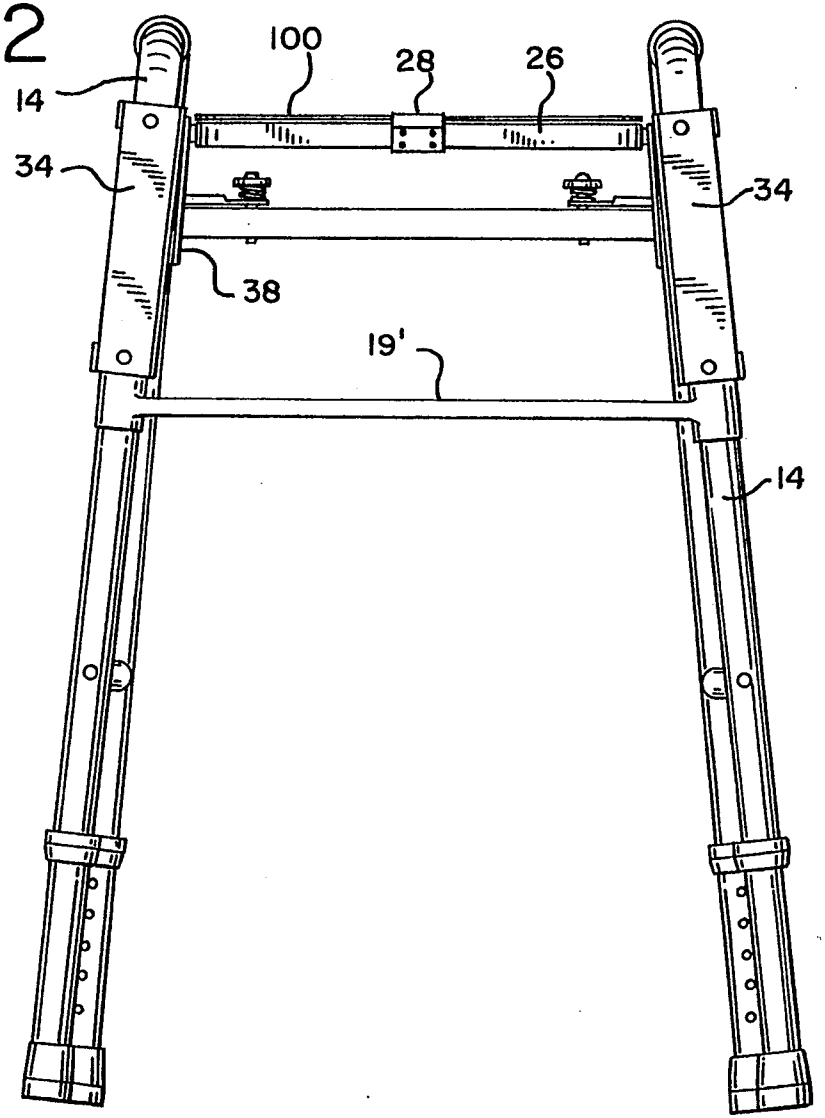
FIG. 2 is a front elevation view of the apparatus of FIG. 1, showing the tray in the upper, raised position.
Figure 3:
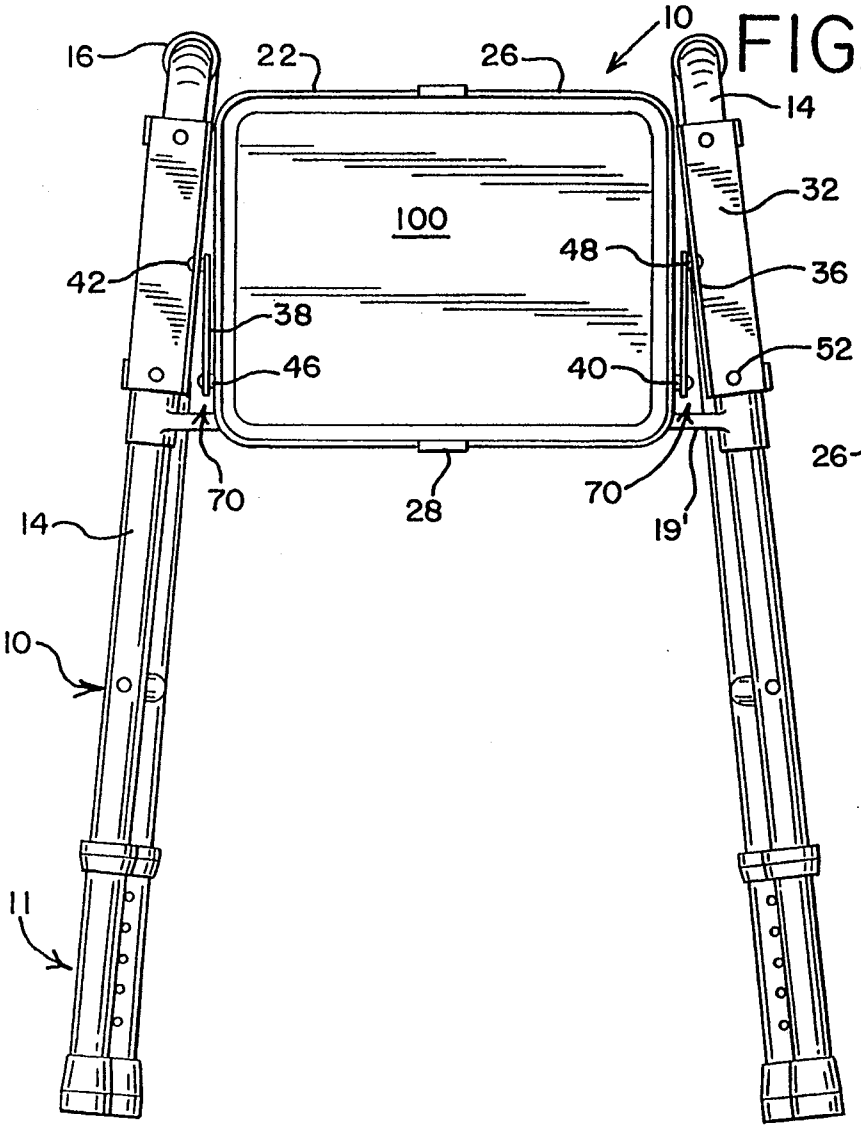
FIG. 3 is a front elevation view of the apparatus of FIG. 1, showing the tray in the lower storage position.

FIGS. 2 and 3 indicate that arm 34 of bracket 32 preferably is formed as an elongated rectangle. As shown in FIG. 4, arm 36 of bracket 32 may include a downwardly angled edge 37, such that arm 36 is generally trapezoidal in shape. This shape increases the amount of clearance space to the front of the apparatus when it is secured to walker 10.

Figure 5:
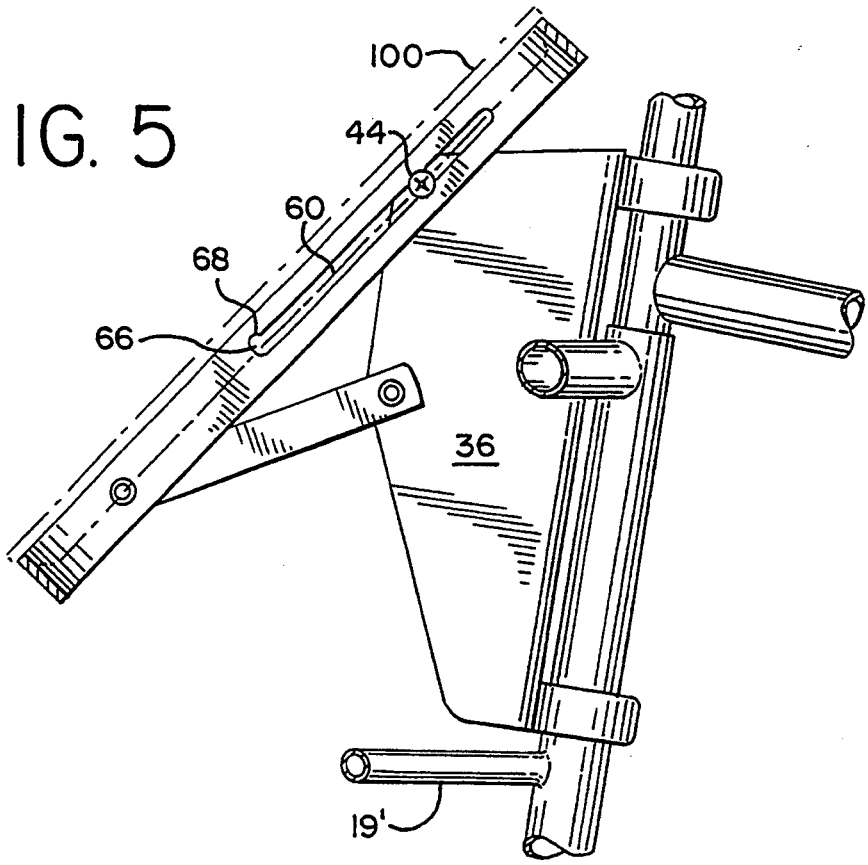
Figure 6:
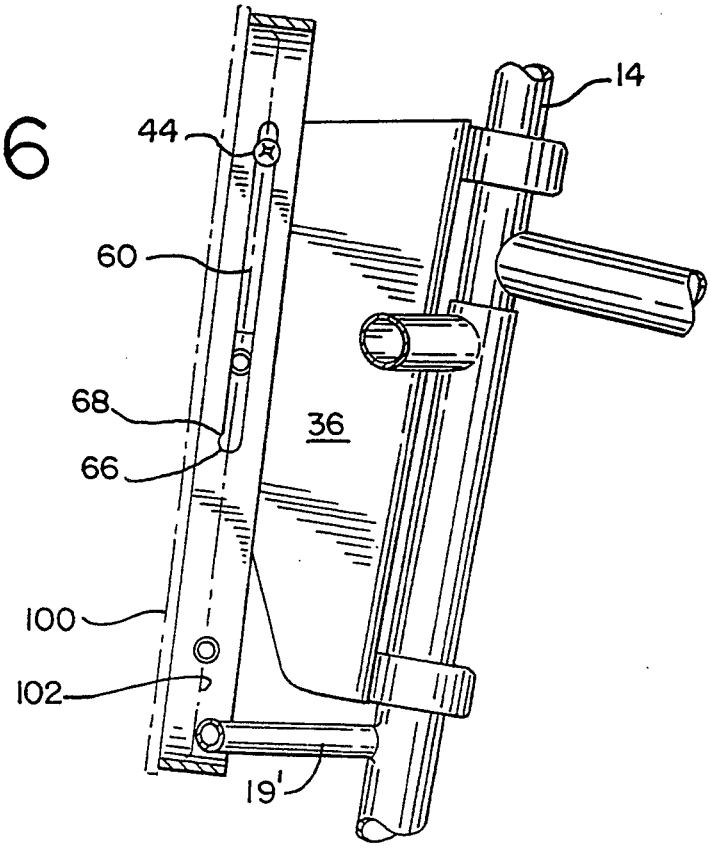

Side members 24 of frame 22 are provided with an elongated slot 60 best seen in FIG. 4. The slot 60 receives and guides a stud 44 which is mounted on arm 36. Thus, in operation as shown in FIGS. 4, 5 and 6, stud 44 remains fixed in position with respect to arm 36, but slot 60 slides past stud 44 as tray frame 22 is raised or lowered.

Slot 60 includes a first end 62 having a semi-circular shape, and a second end 64 provided with an upwardly extending locking notch 66. When the tray frame 22 is placed in the upper, raised position of FIG. 4, stud 44 engages notch 66, thereby locking the frame 22 in the upper position. However, firm downward pressure on tray frame 22 or tray 100 thereon will cause stud 44 to slip past the shoulder 68 formed by the intersection of notch 66 and slot 60. Stud 44 will then slip along slot 60, enabling the tray frame 22 to be lowered into the storage position of FIG. 6. During both the raising and lowering operations, pivots 40 and 42 rotate, thereby enabling arm 38 to pivot on pivots 40 and 42. When the frame 22 is placed in the storage position of FIG. 6, further downward movement of frame 22 is prevented by bottom surface 102 of tray 100, which surface 102 protrudes through frame 22 and abuts against brace 19'.

Thus, the forward protrusion of V-shaped brace 19' prevents tray 100 or frame 22 from contacting the user of walker 10. This is desirable because the user's legs may be located directly behind brace 19'.

Referring again to FIG. 3, the walker 10 is preferably constructed such that leg members 14 are arranged in an opposed, non-parallel, downwardly, outwardly tapering arrangement, such that the lateral distance between leg members 14 is greater at the base 11 of the walker 10 than at the top 10'. However, since frame 22 is preferably formed as a rectangle, such that sides 24 are parallel, a space 70 exists between frame 22 and leg member 14 which provides clearance for stud 40, arm 38, and pivot 42. Additionally, frame 22 is constructed having lateral dimensions sufficiently narrow to enable clearance of stud 40 adjacent clearance space 70. This arrangement permits arm 38 to fit neatly between arms 24 of frame 22 and leg members 14 when the tray frame 22 is in the lowered, storage position of FIG. 3.

Stud 40 preferably includes a spacer nut 46 disposed between arm 38 and side member 24 of frame 22, as shown in FIG. 3. Also, a washer 48 is interposed between pivot 42 and arm 38. Washer 48 is thinner than spacer nut 46; as a result, when the tray frame 22 is in the upper, raised position of FIG. 2, arm 38 is nearly parallel to leg members 14. When the tray is lowered to the storage position of FIG. 3, arm 38 rotates nearly parallel to side members 24 of frame 22. This structure promotes stability of the tray apparatus by ensuring that weight placed on the tray in the upper position of FIG. 2 is securely transmitted to the legs 14 of the walker. In contrast, when the tray frame 22 is folded down, arms 38 are neatly stored between the frame 22 and the legs 14.

When the apparatus described above is mounted on a conventional walker 10 as shown in FIG. 1, the center of gravity point of the apparatus is aligned with a point 56 immediately adjacent to the intersection of leg members 14 and side members 24. More precisely, the center of gravity point will be on axis A of FIG. 1. At this position, any mass placed on tray 100 or bearing down on tray frame 22 will be directed along axis A to leg members 14 through bracket 32 and arm 38. This arrangement promotes stability of the walker by insuring that any weight placed on the tray 100 is transferred to the walker leg members 14, thereby preventing the walker from tipping forward if tray 100 is overloaded.

Moreover, in the arrangement of FIG. 1, tray frame 22 extends rearwardly only a short distance, thereby ensuring that the legs of the user of the walker 10 remain unobstructed.

Figure 7:
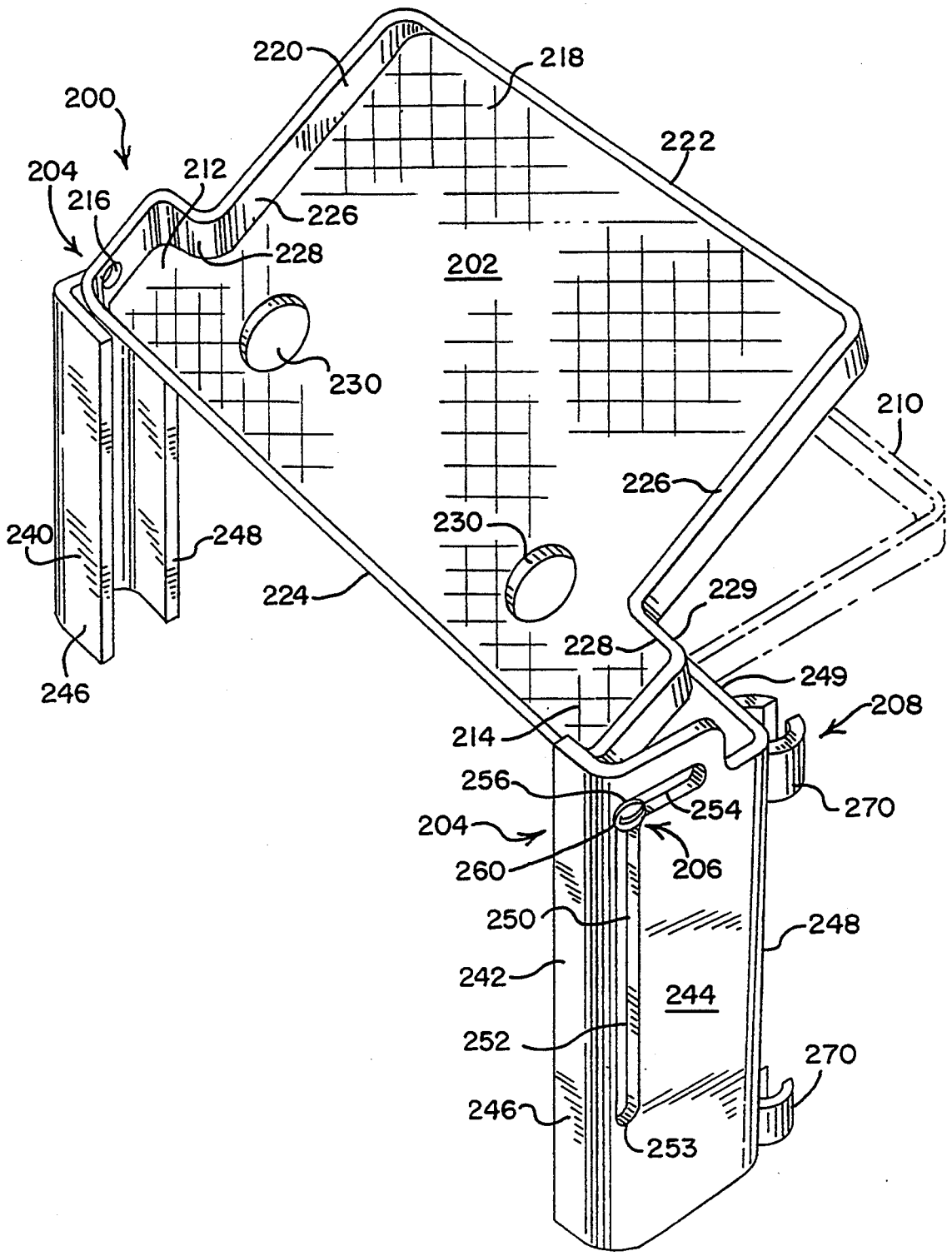
FIG. 7 is a front perspective view of a second embodiment of a tray apparatus of the present invention.
Figure 8A:
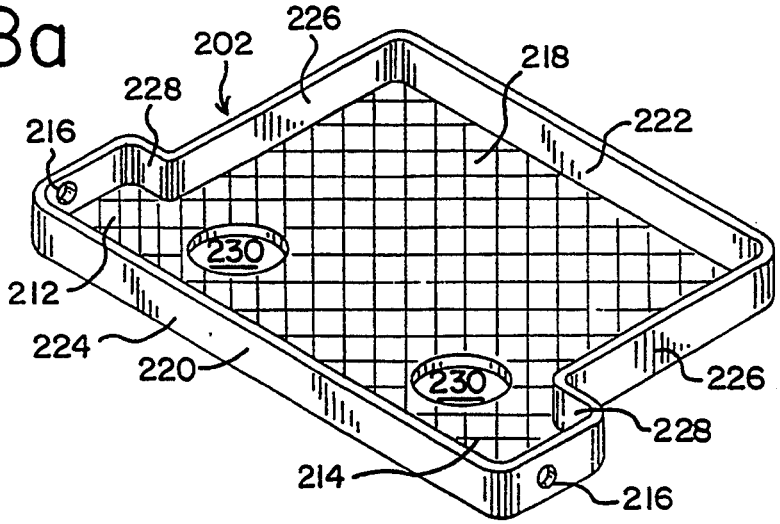
FIG. 8*a* is a perspective view of a tray used in the embodiment of FIG. 7.
Figure 9:
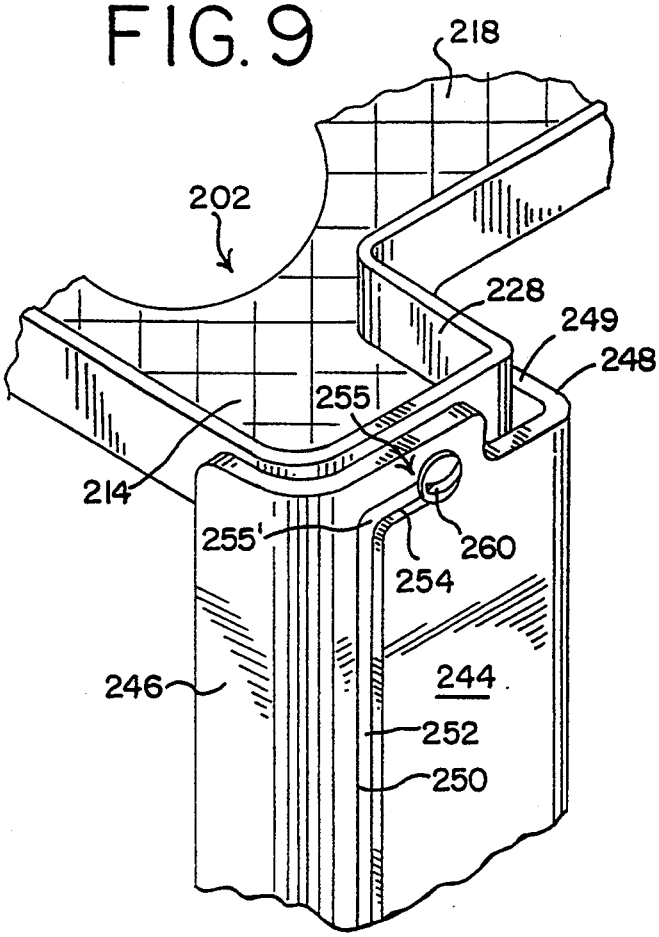
FIG. 9 is an enlarged perspective view of a portion of FIG. 7.

A second embodiment of tray support means according to the present invention is illustrated in FIGS. 7–9. Attention is first invited to FIG. 7, which shows tray support means 200 comprising a tray 202, pivot-means 204, slide means 206, and grip means 208. Using the structure illustrated in FIG. 7, the tray 202 is selectively movable from a horizontal position 210 (illustrated in phantom) to a generally vertical storage position (not shown). FIG. 7 shows tray 202 moved partly between these positions.

Tray 202 preferably comprises a unitary, molded plastic tray having a generally rectangular floor 218 including two laterally extending arms 212, 214. The perimeter of floor 218 is surrounded by an upstanding lip 220, which serves to contain spilled liquids and prevent articles from sliding off floor 218 when the walker is in motion. Lip 220 includes a rear wall 222, a front wall 224 having a length longer than wall 222, and two side walls 226. Short, lateral walls 228 define, in part, arms 212, 214. The floor 218 preferably further includes plural holes 230 into which frustoconical beverage cups or other articles (not shown) may be placed, to prevent the cups and the like from sliding off tray 202 when the walker is moving. Arms 212 and 214 are provided to define clearance space rearward of arms 212 and 214 through which the tubular frame members of the walker may protrude, as will be described further below. Two holes 216 are provided in lip 220, as best seen in FIG. 8*a*. As described below, studs 260 are secured in the holes 216 and engage the brackets 240, 242 to permit movement of tray 202.

Figure 8B:
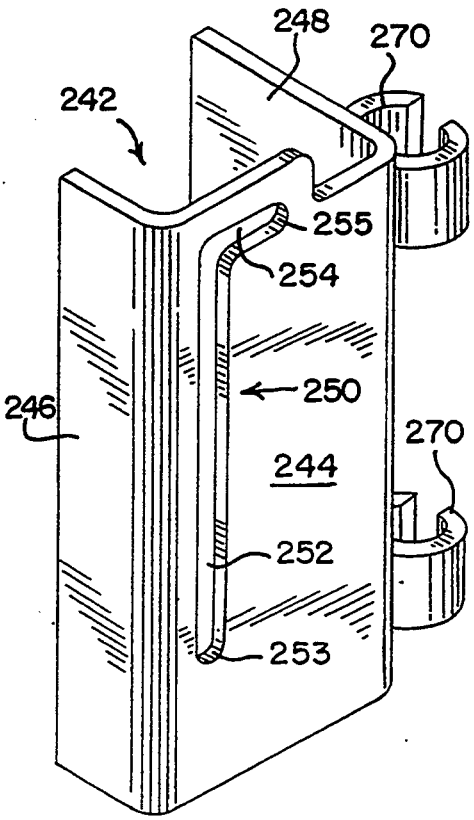
FIG. 8*b* is a perspective view of a guide clamp assembly used in the embodiment of FIG. 7.

Tray support means 200 includes left and right slide brackets 240, 242 illustrated in detail in FIG. 8*b*. FIG. 8*b* shows details of right bracket 244, but bracket 242 is symmetrically identical to the bracket of FIG. 8*b*. Bracket 242 includes a side plate 244 having a guide slot 250 therein, a front plate 246 secured at a right angle to plate 244, and a rear plate 248 secured at a right angle to a rear edge of plate 244. Thus, bracket 242, when viewed from above, generally is shaped in the form of a "U."

Plural rearwardly-facing spring clips 270 are connected to rear plate 248. The clips 270 enable removal of brackets 242, 240 from the upright frame members of a Guide slot 250 is generally formed in an elongated, inverted "L" shape, as shown in FIG. 8*b*. A right angle is formed by generally vertical slot element 252 and horizontal slot portion 254. As described below, the slot 250 receives stud 260 secured in holes 216 of tray 202, and guides the stud 260 through a path defined by slot 250.

FIG. 9 illustrates tray 202 in the horizontal, raised position at which articles may be conveniently placed on the horizontal floor 218 of tray 202. In the position of FIG. 9, stud 260 rests against the rear end 255 of horizontal slot portion 254. In this position, lower edge 229 of wall 228 rests flush on top edge 249 of plate 248. Thus, edge 249 of plate 248 acts as a stop for tray 202, preventing downward tilting of tray 202 and insuring that floor 218 is oriented horizontally.

When a user of tray 202 desires to slide tray 202 into the lower, storage position, thereby enabling unobstructed use of the walker, the user pushes tray 202 forward, causing stud 260 to move forward along horizontal slot portion 254. When stud 260 reaches front and 255 prime of slot portion 254, the user may rotate tray 202 upward into the angled position shown in FIG. 7. Thereafter, the user may continue to rotate tray 202 upward until floor 218 is oriented vertically. Tray 202 may then be pushed down, such that stud 260 is guided downward along vertical slot portion 252, until stud 260 reaches end 253 of slot portion 252. At this point, gravity will retain stud 260 against end 253, causing tray 202 to remain retracted in a generally vertical, storage position.

Using the structure described above, a user of tray support means 200 receives the benefit of a conveniently accessible, sturdy, stable, horizontal tray 202 which may be easily pushed forward and retracted into a vertical storage position. In the storage position, the tray is securely stowed forward of the user's legs, enabling unobstructed use of the walker in normal fashion.

Many variations and modifications are possible of the teachings of the present invention as described above. Thus, the scope of the invention should be determined from the appended claims and not solely from the detailed description provided above.

What is claimed is:

1. A tray support for holding articles proximate to an invalid walker, comprising:

tray holding means;

said tray holding means having a pivot means allowing the tray holding means to pivot and move between first and second positions;

guide means including an elongated guide slot that slideably receives the pivot means, one end of the guide slot having a turned portion whereby the pivot means (1) slides along the guide slot as the tray holding means is moved between its first and second positions, and (2) is located in the turned portion in one of the two positions of the tray holding means;

grip means on the tray support for detachably securing the tray holding means and the pivot means to an invalid walker.

2. Tray support means for supporting articles proximate to an invalid walker, comprising:

a tray formed with left and right laterally extending arms, each arm having pivot means extending therefrom;

slide means for slideably moving said tray between a storage position and a horizontal position, the slide means comprising a pair of slide brackets, each slide bracket having an elongated guide slot therein, the guide slot having a turned portion at one end, the pivot means being slidingly received in the guide slot; and grip means on the slide means for detachably securing the tray and the slide means to an invalid walker.

3. The tray support means of claim 2, wherein the guide slot has a shape defined by an elongated right angle.

4. The tray support means of claim 3, the grip means comprising plural rearwardly facing spring clips connected to the bracket plate.

5. The tray support means of claim 4, wherein the tray is formed of molded plastic.

* * * * *